United States Patent [19]

Calmes

[11] Patent Number: 4,714,224

[45] Date of Patent: Dec. 22, 1987

[54] COLLAPSIBLE EASEL FOR ARTISTS

[76] Inventor: Bobbie G. Calmes, 2449 Seracedar St., Baton Rouge, La. 70816

[21] Appl. No.: 25,185

[22] Filed: Mar. 12, 1987

[51] Int. Cl.[4] ..... A47B 97/08

[52] U.S. Cl. ..... 248/465; 248/439; 248/164; 108/10; 108/118

[58] Field of Search ..... 248/465, 460, 439, 164, 248/169, 463, 464, 154, 150; 108/10, 9, 119, 118, 90, 39, 34

[56] References Cited

U.S. PATENT DOCUMENTS

| | | | |
|---|---|---|---|
| 2,672,182 | 3/1954 | Gwin et al. | 108/90 |
| 2,744,712 | 5/1956 | Brandt | 248/464 X |
| 3,103,900 | 9/1963 | Lippman | 108/9 X |
| 4,404,914 | 9/1983 | Taylor | 108/9 |

FOREIGN PATENT DOCUMENTS

| | | | |
|---|---|---|---|
| 179234 | 11/1906 | Fed. Rep. of Germany | 108/9 |
| 211143 | 6/1909 | Fed. Rep. of Germany | 108/34 |
| 2833398 | 2/1980 | Fed. Rep. of Germany | 108/90 |
| 428159 | 8/1911 | France | 108/9 |
| 39228 | of 1931 | France | 108/9 |
| 63830 | 4/1913 | Switzerland | 108/9 |
| 6069 | of 1914 | United Kingdom | 108/9 |

*Primary Examiner*—Ramon S. Britts
*Assistant Examiner*—Karen J. Chotkowski

[57] ABSTRACT

A collapsible easel for artists and the like to support flexible or rigid drawing surfaces in various modes of operation comprising a composite outer leg unit joined co-axially to a similar composite inner leg unit that are pivotal from a collapsed co-planar position to extended operative positions within quadrant arcs, each having an upper and lower horizontal member and each a pair of parallel main legs which house correspondingly co-extendible auxiliary legs and individually extendible leveling legs which have releasable locking means providing height and leveling adjustment thereto, a stabilizer bar pivotally interconnected to one lower horizontal member extended in perpendicular alignment therefrom slidably and pivotally engaged to the other lower horizontal member having a releasable locking means to support the extended positions of the composite leg units, a translatable counter pivotal structure slidably and pivotally engaged perpendicularly to the upper horizontal member of the composite inner leg unit having a releasable locking means; a media supporting platform structure having an arrangement of receiving members secured to its back surface area to releasable engage the same widthwise or lengthwise to the upper horizontal member of the composite outer leg unit and to the counter pivotal structure by which it is supported and regulated in angular positions as well as in tilting-rotational positions; an optional accessory attachment means to be engageable by adjustable locks longitudinally to either edge of the platform structure and to contain drawing implements and the like therein and to secure and support an elective drawing surface optionally therewith. When the easel is in a collapsed position the composite leg units are co-planar with the counter pivotal structure, the stabilizer bar is vertically disposed adjacent therewith and each are secured thereto by the corresponding receiving members of the platform structure engaged therewith providing a compact transportable and storable unit.

7 Claims, 14 Drawing Figures

COLLAPSIBLE EASEL FOR ARTISTS

BACKGROUND OF THE INVENTION

Conventional easels used by artists normally have a pair of rigid forward legs and one or more pivoted legs extending rearwardly therefrom, the forward legs having at least one horizontal supporting member thereon upon which the lower edge of a canvas or artist's board is supported. Examples of easels of this type are taught by U.S. Pat. Nos. 3,202,471; 2,953,341; 2,565,078 and 2,064,232. Easels of this type are highly successful for studio or semi-perminent locations but for the purposes of transporting or storing are awkward and consume a considerable amount of space both in relocation and storage, as a result attempts have been made to provide collapsible type easels. Examples of collapsible easels are taught by U.S. Pat. Nos. 4,453,470; 4,057,215; 3,244,450; 3,095,666; 3,095,665 and 2,549,306. Easels of this type fail to provide compactness with essential features that are versatile in accommodating artists of various media.

SUMMARY OF THE INVENTION

It is one of the principle objectives of the present invention to provide a collapsible easel in which the structure is relatively simple, light-weight but strong and durable, as well as providing for minimum operation required to transform the easel from a small, compact transportable and storable unit to various modes of operation.

It is another object of the invention to provide a platform structure having a supportive top surface area, opposite side edges, opposite end edges, receiving means each secured to one end portion and to one side portion of the back surface area and a co-pivotal receiving means secured at one of its ends to the central portion thereof having its opposite end pivotal 360 degrees therefrom.

It is a further object of the invention to provide a composite outer leg unit comprising a first upper horizontal member rotatably interconnected at right angles to a first pair of parallel main legs, a first lower horizontal member connected at right angles to a first pair of co-extendible parallel auxiliary legs that are correspondingly housed in said first pair of main legs, a pivotal connective means engaged in the horizontal axis of said first lower horizontal member. A composite inner leg unit appropriately shorter in overall length and width than said composite outer leg unit comprising a second upper horizontal member connected at right angles to a second pair of parallel main legs, a second lower horizontal member connected at right angles to a second pair of co-extendible parallel auxiliary legs that are correspondingly housed in said second pair of main legs, a first pivotal guide means pivotally interconnected in the horizontal axis of said second lower horizontal member by bearing connective means contained therein, having a releasable first locking means thereof, a counter pivotal structure comprised of a pivotal support means and a lever bar means and said pivotal support means includes a slidable hinging connector means parallel to a turn-mount means and each interconnected at right angles to a pair of parallel side members, and said lever bar means secures one end into said hinging connector means extending perpendicularly therefrom engaging slidably through a second pivotal guide means which is pivotally interconnected in the horizontal axis of said second upper horizontal member by bearing connective means contained therein, having a releasable second locking means thereof, and said composite leg units share a stabilizer bar means having one end secured into said pivotal connective means and an opposite free end extending perpendicularly therefrom slidably through said first pivotal guide means into a cap means.

Still another object of the invention is to provide co-axial connector means each interconnected between the upper and lower ends of each said first and second main leg and each having right-angled branch connector members mated in a common horizontal axis by bearing connective means contained therein, pivotally joining said composite leg units to one another to permit the same to be pivoted in opposite directions away from their common inoperative and collapsed plane to various extended positions, operative within quadrant arcs thereof, while said free end of said stabilizer bar means swings downwardly in a 90 degree arc away from its vertical inoperative collapsed position adjacent said upper horizontal members of said co-planar composite leg units to an operative horizontal plane to be locked therein by said first locking means to supportively maintain said extended positions desired and said end receiving means or said side receiving means enable said platform structure to be pivotally engaged to said first upper horizontal member respectively in a widthwise or lengthwise operative position as desired, and said counter pivotal structure is directed slidably upward as well as pivotally downward from a suspended inoperative position in the common plane of said composite inner leg unit to operatively engage its turn-mount means into said co-pivotal receiving means, enabling said platform structure to be regulated by said lever bar means to preferred angular positions supportively within a provided approximate 90 degree arc thereof and maintained by said second locking means and when said easel is reversed from the foregoing operative positions to its collapsed condition, said arrangement of each said receiving means correspondingly permit reengagement of said platform structure to said disposed co-planar composite leg units and to said suspended position of said counter pivotal structure maintaining said vertically disposed stabilizer bar means adjacent therewith providing a compact collapsed unit for transporting and storing.

A still further object of the invention while it is operative is to electively extend each said pair of co-extendible auxiliary legs slidably downward from their housed positions to positions in which to adjustably elevate, as well as level said easel and releasably lock therein by their respective locking means.

Still another object of the invention while it is operative is to provide leveling legs individually housed in each said auxiliary leg to be electively extendible, slidably downward from their housed positions to positions in which to adjustably level, as well as elevate said easel and releasibly lock therein by their respective locking means.

A still further object of the invention when it is operative is to provide a supported 360 degree tilting-rotational mode of operation to said platform structure in which said counter pivotal structure remains engaged to said co-pivotal receiving means while said first upper horizontal member is conveniently disengaged from said platform structure.

A still further object of the invention is to provide an adaptive accessory attachment means to releasibly engage either outermost edge of said platform structure, and to contain drawing implements and the like therein, and to secure and support an overlying drawing surface engaged electively therewith.

Still another object of the invention is to provide a handle means for transporting said compactly collapsed easel unit by partially extending said first pair of auxiliary legs disposing said first lower horizontal member an appropriate distance away from the adjacent edge of said platform structure and locking therein by said respective locking means thereof.

These and other objects and advantages of the invention will become better understood by reference to the following description of the accompanying drawings, wherein:

DETAILED DESCRIPTION

Figure 1:
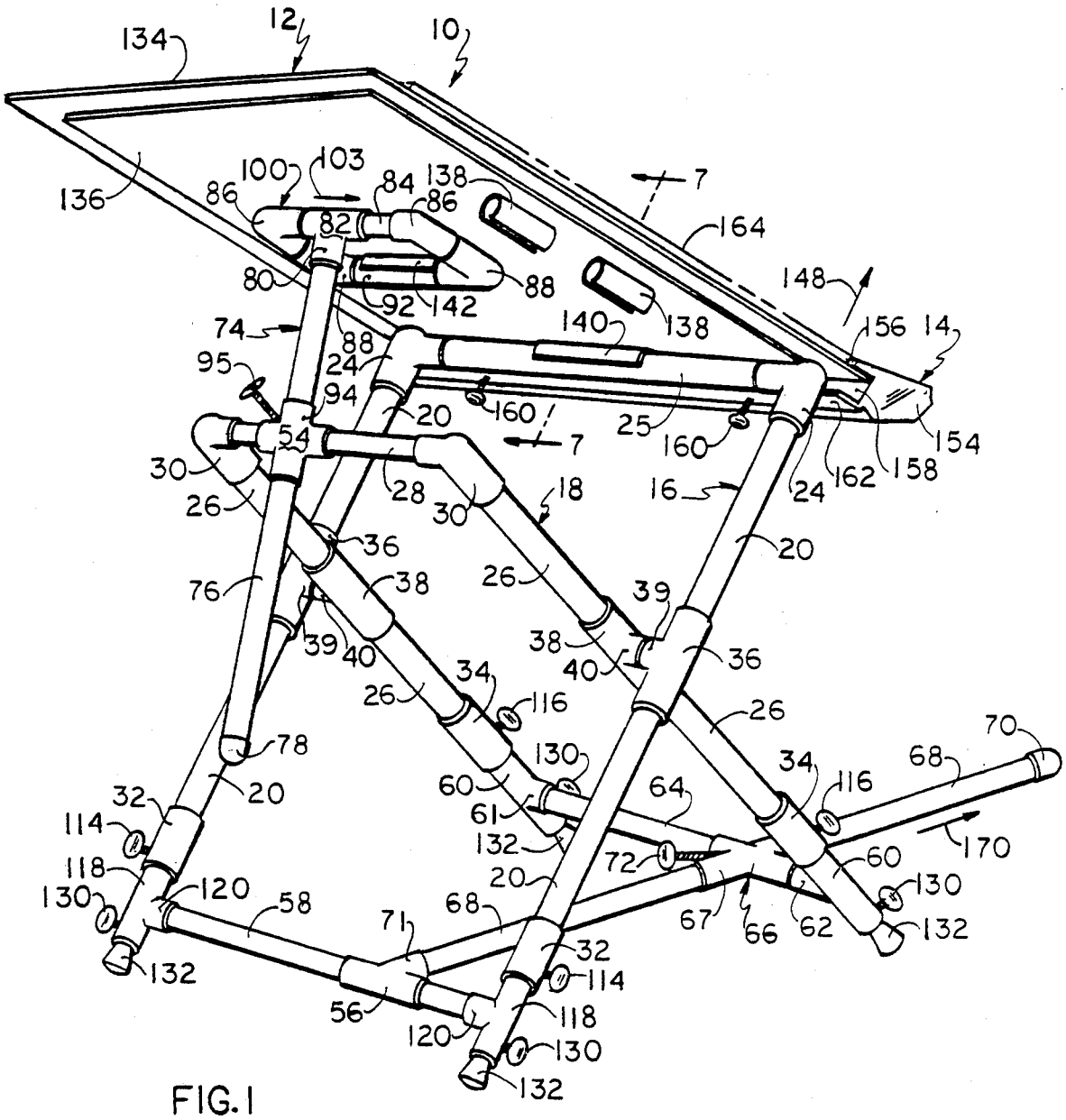
FIG. 1 is a pictorial view of the collapsible easel comprising the present invention showing the same adjusted to an operative intermediate elevation, having auxiliary and leveling legs housed therein in fully retracted positions, illustrating the rectangular platform structure engaged widthwise as an alternative position to a lengthwise engagement and supported in an angular position within an approximate 90 degree arc thereof, showing the accessory attachment means optionally engaged therewith to a forward edge of said platform structure.
Figure 6:
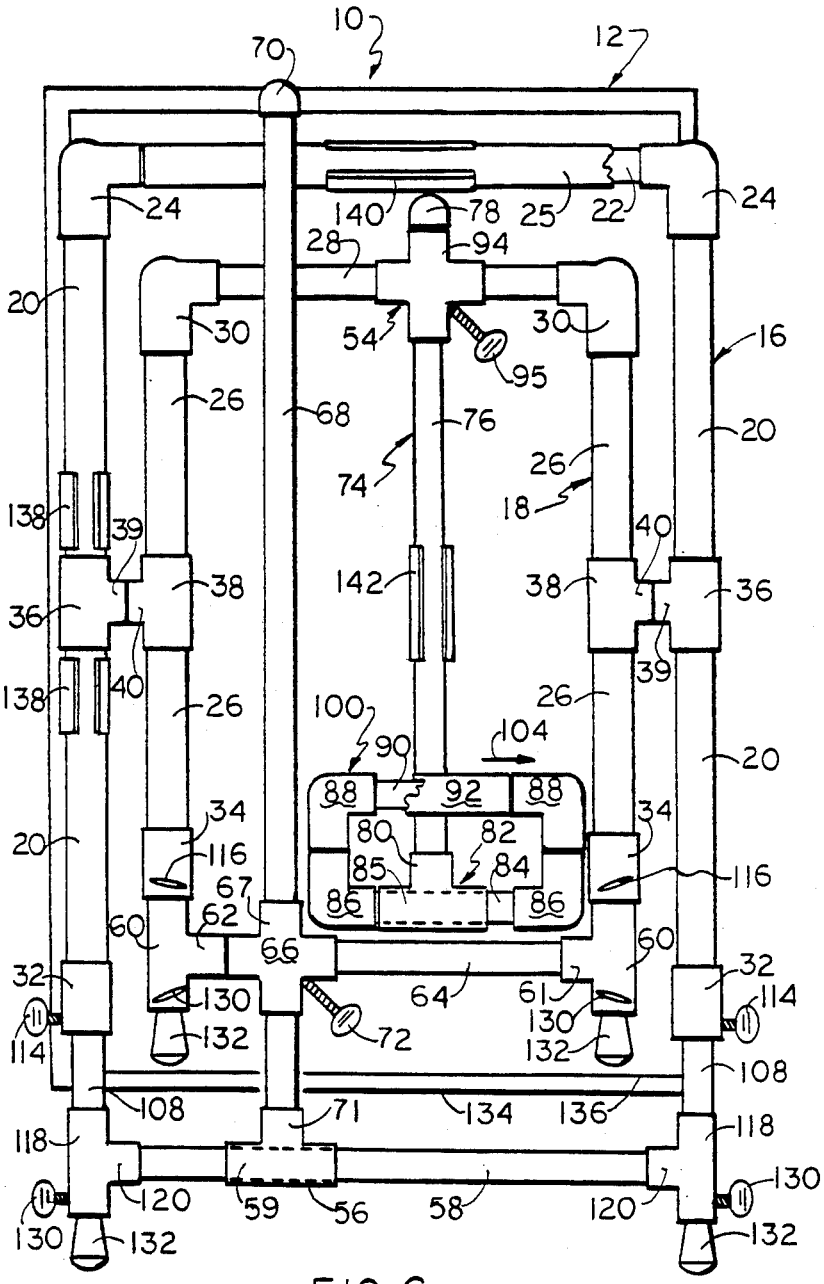
FIG. 6 is a front elevation view of the easel shown in FIG. 5 showing the back portion of the platform structure thereof and the lower portion of the composite outer leg unit partially extended downwardly away from the lower edge of said platform structure providing an intended handle means.

Referring to FIGS. 1 and 6 the collapsible easel of the present invention, generally designated 10, is comprised generally of a platform structure 12, an accessory attachment means 14, a tubularly composite outer leg unit 16 and a tubularly composite inner leg unit 18.

Figure 12:
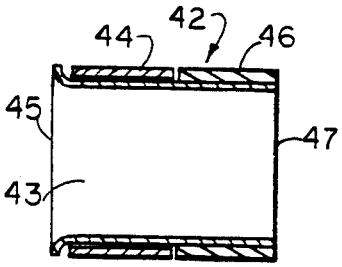
FIG. 12 is an enlarged cross-sectional view illustrating details of bearing connective means used in FIGS. 10 and 11.
Figure 13:
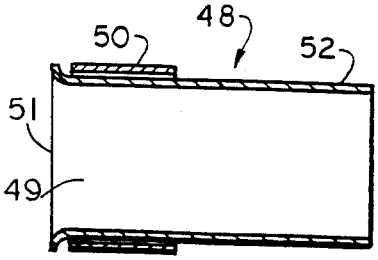
FIG. 13 is an enlarged cross-sectional view illustrating details of bearing connective means used in FIGS. 9 and 10.

The composite outer leg unit 16 includes a pair of parallel main legs 20 having upper ends connected at right angles to opposed side ends of a rigid inwardly disposed upper horizontal member 22 (FIG. 6) by elbow connectors 24. The outwardly disposed upper horizontal member 25 is pre-engaged rotatably therebetween, as shown, along the horizontal axis thereof. The similar composite inner leg unit 18, appropriately shorter in overall length and width than said composite outer leg unit 16, also includes a pair of parallel main legs 26 having upper ends connected at right angles to opposed side ends of an upper horizontal member 28 by elbow connectors 30. The lower ends of said main legs 20 and 26 are connected into the upper ends of opposed side coupling connectors 32 and 34, respectively. The intermediate ends of each main leg 20 and 26 are connected into opposite longitudinal ends of each co-axial tee connector 36 and 38, respectively (see FIG. 11). Each co-axial tee connector 36 and 38 has a perpendicular branch member 39 and 40 respectively, facing one another in mated contact as shown. Bearing connective means 42 illustrated in FIG. 12 is comprised of a tubular shaft 43 having a sleeve bearing 44 engaged to its rotatable journal portion and abutting its adjacent flared end 45, and a bushing adpator 46 fixedly engaged to its remaining portion flush to its opposite end 47 and abutting the sleeve bearing 44. Bearing connective means 48 illustrated in FIG. 13 is comprised of a tubular shaft 49 having a sleeve bearing 50 engaged to its rotatable journal portion and abutting its adjacent flared end 51 leaving a remaining extended portion 52.

Figure 9:
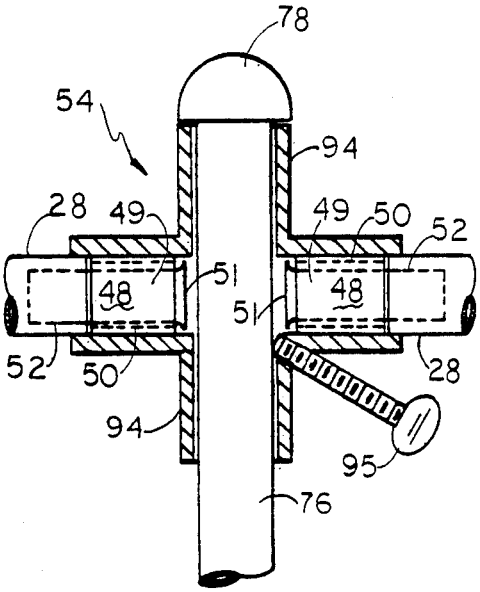
FIG. 9 is an enlarged fragmentary cross-sectional view detailing the pivotal guide connector of the upper horizontal member of the composite inner leg unit shown in FIG. 6.
Figure 11:
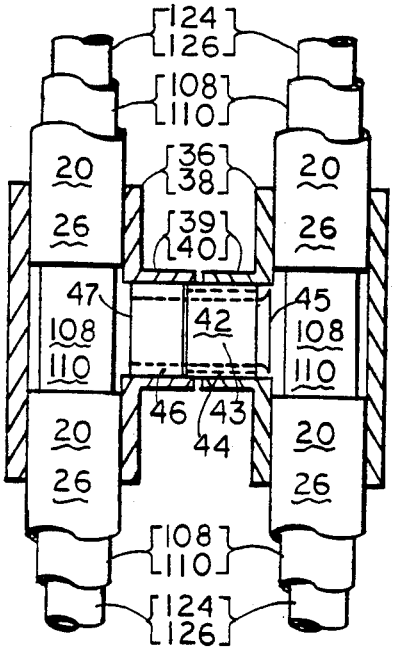
FIG. 11 is an enlarged fragmentary cross-sectional view detailing the pivotally mated co-axial tee connectors of the intermediated leg portions of the composite inner and outer leg units shown in FIG. 6.
Figure 10:
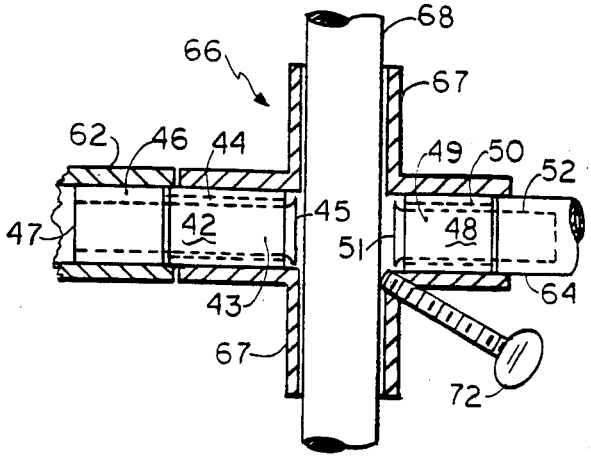
FIG. 10 is an enlarged fragmentary cross-sectional view detailing the pivotal guide connector of the lower horizontal member of the composite inner leg unit shown in FIG. 6.

The composite leg units 16 and 18 are pivotally joined to one another by having their mated pairs of branch members 39 and 40 each provided with the bearing means 42 (FIG. 12) engaged in a typical manner exemplified in FIG. 11 showing the sleeve bearing 44 and the bushing adaptor 46 secured into the corresponding bores of said branch members 39 and 40, the shaft 43 ready to yield rotatably in accordance therewith whereby providing the composite leg units 16 and 18 with bearing support within their pivotal quadrant arcs. The upper horizontal member 28 pivotally engages the pivotal guide connector 54 by having each of its intermediate ends provided with the bearing means 48 (FIG. 13) engaged in the manner illustrated in FIG. 9 which shows the extended portions 52 of each bearing means 48 urged fixedly into the corresponding bores of said intermediate ends thereof, the sleeve bearings 50 secured into the corresponding bores of said pivotal guide connector 54, the shaft 49 ready to yield rotatably in accordance therewith providing bearing support to the pivotal guide connector 54 within a 360 degree arc. The pivotal tee connector 56 has been pre-bored through its longitudinal run section and slidably disposed laterally in the position shown, providing a suitable pivotal engagement with the corresponding lower horizontal member 58 as indicated at 59 in FIG. 6. Each rigid tee connector 60 has a respective perpendicular branch member 61 and 62 connecting the opposed sides of the lower horizontal member 64 in a manner in which one end of the lower horizontal member 64 connects into the branch member 61, its opposite or intermediate end is provided with the bearing means 48 (FIG. 13) engaged in the manner illustrated in FIG. 10 showing the extended portion 52 urged fixedly into the corresponding bore of said opposite or intermediate end thereof, the sleeve bearing 50 secured into the adjacent corresponding bore of the pivotal guide connector 66 and the shaft 49 ready to yield rotatably in accordance therewith. The opposite side end of pivotal guide connector 66 and the adjacent branch member 62 are provided with the bearing means 42 (FIG. 12) engaged in the manner illustrated in FIG. 10 showing the sleeve bearing 44 and the bushing adaptor 46 secured into the corresponding bores thereof, and the shaft 43 ready to yield rotatably in accordance therewith. The pivotal guide connector 66 has been pre-bored longitudinally through its perpendicular guideway 67 slidably engaging the stabilizer bar 68 therein (see FIG. 10). The stabilizer bar 68 connects its free end into the cap member 70 and its opposite end in pivotal alignment therefrom into branch member 71 of the pivotal tee connector 56. The threaded fastener 72 is threadedly engaged diagonally into the pivotal guide connector 66 (see FIG. 10) providing a locking means to the stabilizer bar 68.

Figure 14:
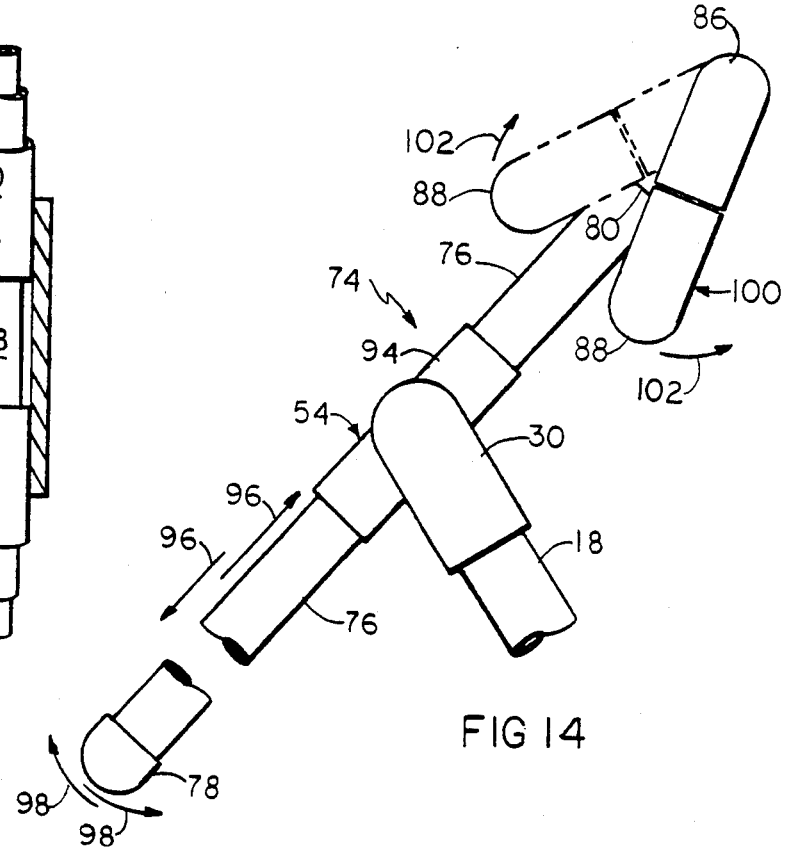
FIG. 14 is an enlarged fragmentary side view of the extended upper portion of the composite inner leg unit shown in FIG. 1, illustrating the counter pivotal structure thereof.

The counter pivotal structure, generally designated 74, comprises a lever bar 76 and a pivotal support member, generally designated 100. The lever bar 76 connects a free end into the cap member 78 and an opposite end into the branch member 80 of the hinging tee connector 82 which has been pre-bored through its longitudinal run section corresponding to the carriage bar 84 as indicated at 85 in FIG. 6, providing a slidable and pivotal engagement therefrom. The opposed side ends of said carriage bar 84 connect into the adjacent corresponding ends of elbow connectors 86. The opposite right-angled ends of said elbow connectors 86 are connected directly to the adjacent ends of elbow connectors 88, by appropriate tubular sections therein, providing rigid side members. The opposite right-angled ends of the elbow connectors 88 connect the opposed side ends of an inwardly disposed support bar 90 (FIG. 6) therein having the outwardly disposed turn-mount member 92 pre-engaged rotatably therebetween along the common horizontal axis thereof. The pivotal guide connector 54 has been pre-bored longitudinally through its perpendicular guideway 94 slidably engaging the lever bar 76 of the counter pivotal structure 74 therein (see FIG. 9). The threaded fastener 95 is threadedly engaged diagonally into said pivotal guide connector 54 as shown in FIG. 9. FIG. 14 illustrates the general manner in which the counter pivotal structure 74 is utilized showing the lever bar 76 translatable in the directions shown by arrows 96 to be locked into positions therealong by threaded fastener 95 (FIG. 1) while its free end 78 is pivotal 360 degrees in the direction shown by arrows 98, while the pivotal engagement of the hinging tee 82 and the carriage bar 84 (FIG. 1) enable the pivotal support member 100 to be pivotal therefrom in the directions shown by arrows 102 between the positions shown by phantom lines and full lines thereof, while the slidable engagement of said hinging tee 82 and said carriage bar 84 enable said pivotal support member 100 to be translatable in the directions shown by arrows 103 and 104 in FIGS. 1 and 6 respectively. The primary purpose of said turn-mount 92, as exemplified in FIG. 1, is to engage said counter pivotal structure 74 into operation, at which time its inner support bar 90 (FIG. 6) is ready to co-pivot, as well as counter-pivot in a rotatable manner therein, being pivotally coordinated with the carriage bar 84 and the pivotal guide connector 54.

Figure 3:
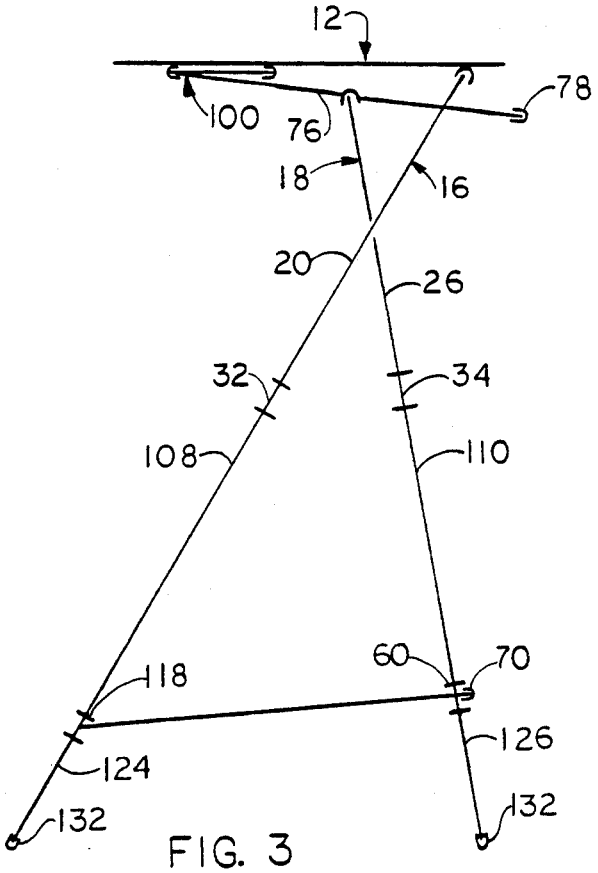
FIG. 3 is a single-line side elevation view of the easel shown in FIG. 1 when the same is adjusted to an operative maximum elevation, illustrating the platform structure prepared for angular positioning within an approximate 90 degree arc therefrom.
Figure 4:
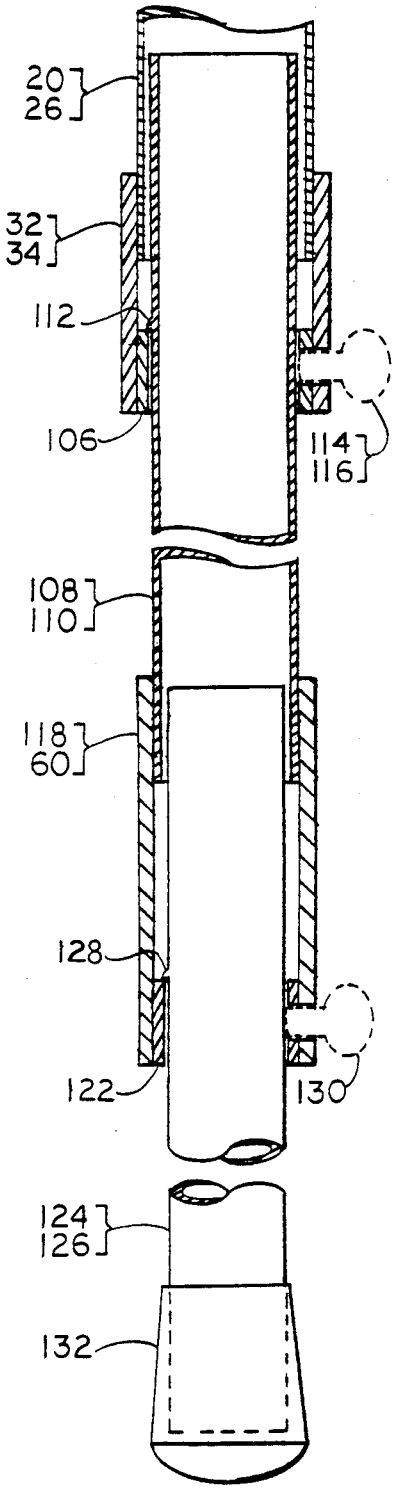
FIG. 4 is a fragmentary and enlarged cross-sectional view showing in full lines details of the auxiliary and leveling legs in their FIG. 3 positions.
Figure 5:
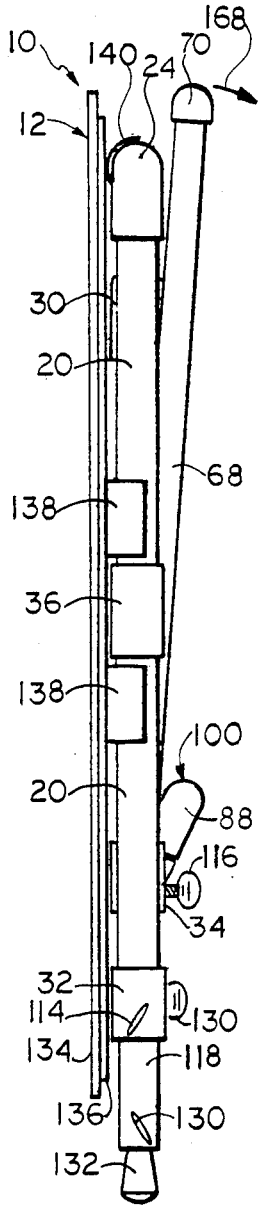
FIG. 5 is a side elevation view showing the fully collapsed and compact condition of the easel shown in FIG. 1 being illustrated without the optional engagement of the accessory attachment means.

Additionally referring to FIG. 4 it will be shown that inside the lower ends of each said coupling connector 32 and 34 is a bushing adaptor 106 secured therein and inside each said main leg 20 and 26 is an auxiliary leg 108 and 110 respectively, slidably housed longitudinally, exposed in fully extended positions as exemplified in FIGS. 3 and 4 and concealed in fully retracted positions in FIGS. 1 and 5. Their upper portions each have an outwardly projected stop means 112, which in FIGS. 1 and 5 are concealed in the upper-most housing portions of their respective main legs 20 and 26, while FIG. 4 shows the same have been carried downwardly in contact with the bushing adaptors 106 halting said upper portions in the lower-most housing portions of their respective main legs 20 and 26 in a proper manner. Outside the lower ends of each coupling connector 32 and 34 is a threaded fastener 114 and 116 respectively, threadedly engaged therefrom through their respective bushing adaptors 106 in the typical manner illustrated in FIG. 4 by phantom lines and oriented in the preferred positions shown in FIG. 1 or 6, providing said auxiliary legs 108 and 110 with releasible locking means in said fully extended and retracted positions, as well as desired positions extended therebetween. The lower ends of the auxiliary legs 108 and 110 are connected into the upper ends of opposed side rigid tee connectors 118 and 60 respectively, and the perpendicular branch members 120, best shown in FIG. 1 or 6, are connected to opposed side ends of the lower horizontal member 58 providing said auxiliary legs 108 as a co-extendible pair as is likewise of said auxiliary legs 110. In FIG. 4 it will also be shown that inside the lower ends of each rigid tee connector 118 and 60 is a bushing adaptor 122 secured therein. Inside each auxiliary leg 108 and 110 is a leveling leg 124 and 126 respectively, slidably housed longitudinally, exposed in fully extended positions, as exemplified in FIGS. 3 and 4 and concealed in fully retracted positions in FIGS. 1 and 5. Their upper portions each have an outwardly projected stop means 128, which in FIGS. 1 and 5 are concealed in the upper-most housing portions of their respective auxiliary legs 108 and 110, while in FIG. 4 the same have been carried downwardly in contact with the bushing adaptors 122, halting said upper portions thereof in the lower-most housing portions of their respective auxiliary legs 108 and 110 in a proper manner. Outside the lower ends of each rigid tee connector 118 and 60 is threaded fastener 130, threadedly engaged therefrom through their respective bushing adaptors 122 in the typical manner illustrated in FIG. 4 by phantom lines and oriented in the preferred positions shown in FIG. 1 or 6 providing each said leveling leg 124 and 126 with a releasable locking means in said fully extended and retracted positions, as well as desired positions extended therebetween. The lower ends of the leveling legs 124 and 126 are each provided with individual base members or feet 132, preferrably of material such as rubber or the like. The co-extendible auxiliary legs 108 and 110 are extendible alternately, providing the easel 10 with front-to-back height adjustment, as well as leveling in the same manner. The leveling legs 124 and 126 are extendible individually providing the easel 10 with leveling, as well as height adjustment accordingly.

Figure 8:
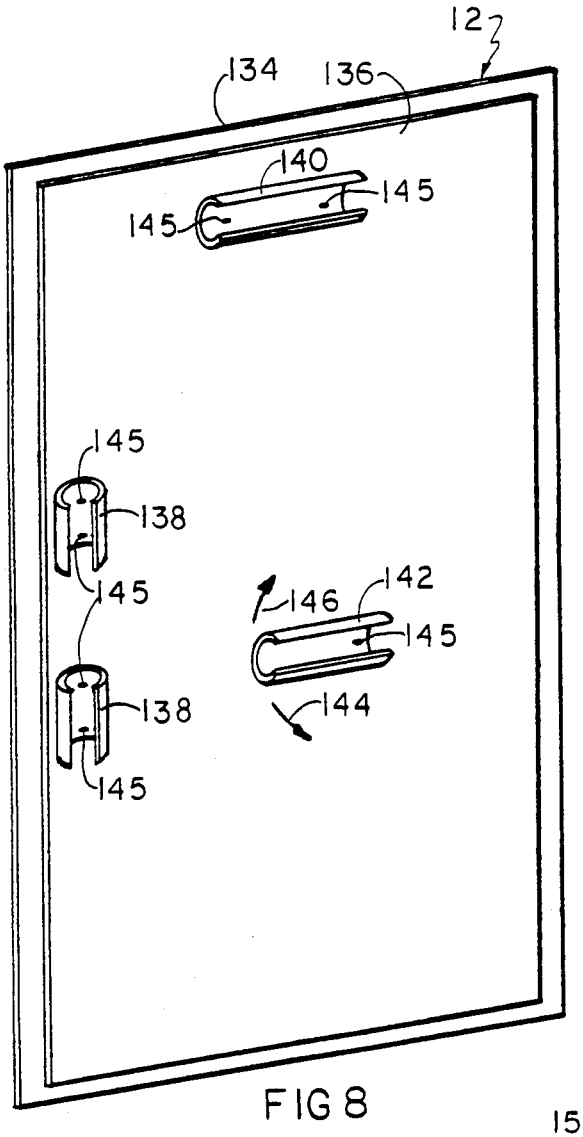
FIG. 8 is a pictorial view of the platform structure in a disengaged position.
Figure 7:
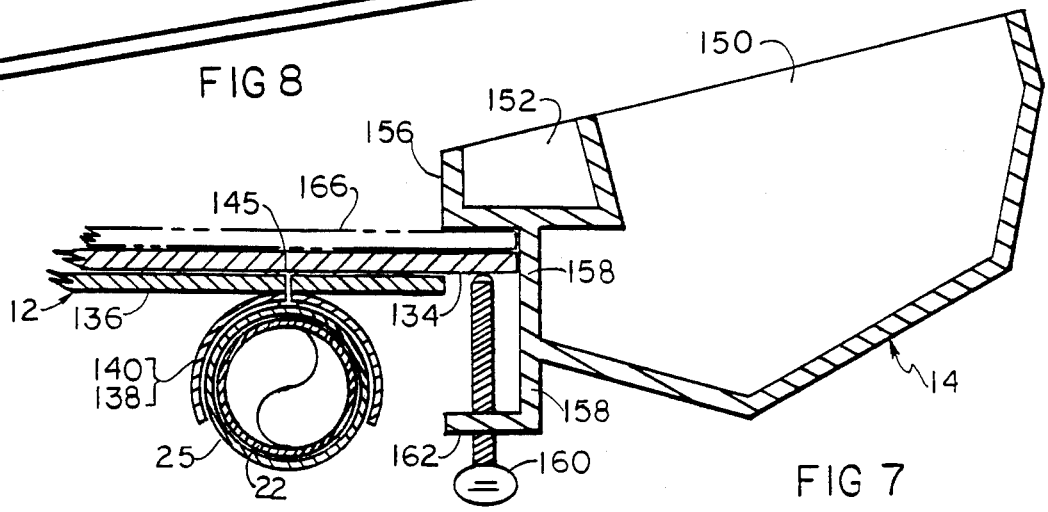
FIG. 7 is a sectional view taken along line 7—7 of FIG. 1 indicating optional positions of the platform structure and the elective drawing surface introduced therewith shown by phantom lines.

Additionally referring to FIGS. 7 and 8 the rectangular platform structure 12 is comprised of a media supporting top panel member 134 bonded adhesively to a similar back panel member 136, which includes within its back surface area a pair of vertically spaced side receiving clips 138 rigidly secured parallel to an adjacent side edge, a horizontally disposed end receiving clip 140 rigidly secured parallel to an adjacent end edge, a centrally disposed co-pivotal receiving clip 142 secured at one of its ends to be pivotal 360 degrees therefrom, as shown by arrow 144 (FIG. 8). The top panel member 134 is of a practical size on which an overlying drawing surface can be supported and secured in a conventional manner or otherwise, as will be described hereinbelow. Each of said receiving clips 138, 140 and 142 are secured preferrably by rivet fasteners 145 in a manner exemplified in FIG. 7. Each of said receiving clips are constructed of tubular material, slotted lengthwise, as shown in FIG. 8, having certain spring properties by which their open regions yield flexibly in an appropriate manner, facilitating engagement and disengagement therein, thereby providing the means by which the platform structure 12 may be conveniently arranged in a compact inoperative position with the composite leg units 16 and 18 shown in FIGS. 5 and 6, as well as to conveniently arrange the same in optional operative positions, as for example in FIG. 1 which shows the end receiving clip 140 has positioned the platform structure 12 widthwise to the rotatable upper horizontal member 25, providing an operative pivotal engagement therefrom, whereas the side receiving clips 138 can alternately position the platform structure 12 lengthwise to said rotatable upper horizontal member 25 to provide an optional pivotal engagement therefrom, as indicated in FIG. 7, meanwhile the adaptable co-pivotal receiving clip 142 can be pivotally adjusted to conform therewith, as indicated by arrow 146 in FIG. 8, to engage the platform structure 12 to the supportive counter pivotal structure 74, accordingly. The platform structure 12 may be arranged in another mode of operation when it is conveniently disengaged only from the upper horizontal member 25, as indicated by arrow 148 in FIG. 1, at which time it can be manipulated in tilting and rotational positions as provided by the supportive counter pivotal structure 74.

Referring now specifically to FIGS. 1 and 7 the accessory attachment 14 is an elongated angular configuration, rigidly comprised of a primary open compartment 150 in its forward main region of equal length to a secondary open compartment 152 in its upper rearward region, each having enclosed opposite ends 154. The secondary compartment 152 forms upper support flange 156, partially extended as shown forming channel member 158 longitudinally, in which threaded fasteners 160 are horizontally spaced and threadedly engaged thereinto from flange member 162. Generally, the accessory attachment 14 provides means in which to contain drawing implements and the like therein, and engages to either edge of the platform structure 12 and also an elective drawing surface therewith in optional positions. (It should be understood that the designation "drawing surface" intends to include flexible sheet-like material, as well as rigid drawing boards, canvases or the like upon which artists sketch and paint). For example, the support flange member 156 provides means of supporting an abutting edge of an appropriate drawing surface that has been positioned in an overlying manner on the platform structure 12, as illustrated by phantom lines 164 in FIG. 1, when said accessory attachment 14 is engaged to a lower horizontal edge of said platform structure 12, as shown. The channel member 158 provides the adjustable means by which the accessory attachment 14 may be optionally engaged to a vertical or horizontal edge of the platform structure 12 or to optionally engage therewith an elective drawing surface in a manner exemplified by phantom lines 166 in FIG. 7.

Figure 2:
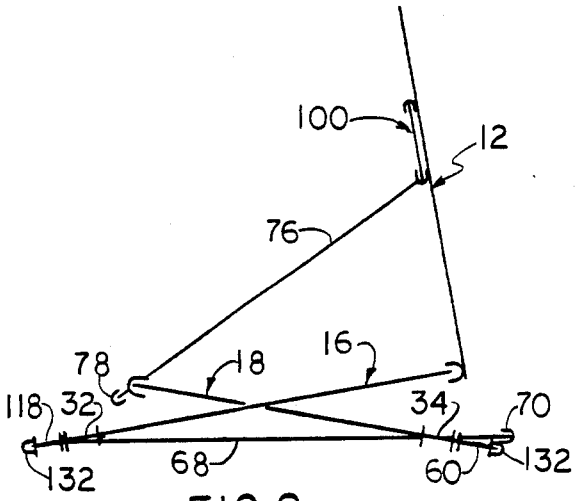
FIG. 2 is a single-line side elevation view of the easel shown in FIG. 1 when the same is adjusted to an operative lower elevation, illustrating the platform structure in a supported angular position within an approximate 90 degree arc thereof.

The easel 10 can be set-up in different elevated positions for operation, including for example, those shown in FIGS. 1, 2 and 3, exemplifying respectively an intermediate, a lower and a maxmum elevator. To set-up the easel 10 to an intermediate elevation from a collapsed compact condition, the platform structure 12 is first disengaged from the co-planar composite leg units 16 and 18 shown in FIGS. 5 and 6 by a convenient pulling-away action therefrom and then laid aside as in FIG. 8. The free end 70 along with its pivotally yielding stabilizer bar 68, shown in FIG. 5, is then pulled downwardly in an approximate 90 degree arc, shown by arrow 168, immediately causing the pivotally yielding composite inner leg unit 18 to extend outwardly, while the composite outer leg unit 16 pivotally yields accordingly in an opposite direction as shown in FIG. 1 where the slidable translation of the lower horizontal member 64 is arranged approximately midway along the longitudinal axis of the stabilizer bar 68, adjusting the composite leg units 16 and 18 in the extended positions shown and locked therein by the threaded fastener 72. It should be understood that when the lower horizontal member 64 is translated further along the longitudinal axis of the stabilizer bar 68, in the same direction of arrow 170 and subsequently locked in the same said manner, the composite leg units 16 and 18 are pivotally extended more widely apart, therefore arranging the easel 10 in lower set-up positions, as in FIG. 2, for example. It should also be understood, when the auxiliary legs 108 and 110 and the leveling legs 124 and 126 are fully extended slidably and locked in by their respective threaded fasteners 114, 116 and 130 (as shown in detail in FIG. 4) and the composite leg units 16 and 18 are adjusted pivotally to fully extended positions and locked in by the threaded fastener 72, that the easel 10 is set-up in a maximum elevation, as in FIG. 3, for example. It is apparent that the extendible and retractable feature of said auxiliary legs 108 and 110 and said leveling legs 124 and 126 provide leveling and height adjustment, as desired, in each appropriate set-up position.

Referring now specifically to FIG. 1, with respect to other elevations as well, such as in FIGS. 2 and 3, it will be shown that subsequent to the set-up operation, the platform structure 12, from FIG. 8, is then engaged pivotally to the rotatable upper horizontal member 25, either lengthwise thereto with respect to said accommodating side receiving clips 138, or, as shown, widthwise with respect to said accommodating end receiving clip 140. The counter pivotal structure 74 is then translated from its suspended position in FIG. 6, first slidably upward, then pivotally downward, whereupon, as in FIG. 1, its turn-mount member 92 engages into the pivotally adaptive co-pivotal receiving clip 142, the lever bar 76 is then locked into a translated position by threaded fastener 95, disposing the platform structure in the exemplary angle illustrated. It is understood that the sufficient length of lever bar 76 arranges and supports the platform structure 12 in other angles as well within an approximate 90 degree arc thereof, such as between the illustrated positions shown in FIGS. 2 and 3, which also show, by example, different yielding positions of the pivotal support member 100, being in coordination therewith, with respect to its previously described operational features depicted in FIG. 14. The optional engagement of the accessory attachment 14 to the platform structure 12 may be applied in the appropriate manner, as is desired, with respect to its previously described versatility, that is, it may be engaged to either a vertical or horizontal edge of the platform structure 12, while optionally supporting therewith an elective drawing surface as exemplified in FIGS. 1 and 7, while containing drawing implements and the like therein. The tilting-rotational mode of operation of the platform structure 12 may be utilized, when desired, in the convenient manipulative manner as previously discussed, that is, the disengagement of said platform structure 12 from the upper horizontal member 25 permits said counter pivotal structure 74, in cooperation with the pivotal guide connector 54 and the co-pivotal receiving clip 142, to provide and support versatile movements thereof while preferably locked in by threaded fastener 95.

To collapse the easel 10 into a compact condition for storage or transporting, as in FIGS. 5 and 6, attention is directed to FIGS. 1, 2 and 3. It is preferrable to first disengage the platform structure 12 from the turn-mount member 92 of the counter pivotal structure 74 and then from the upper horizontal member 25. The receiving clips 142 and 140 or 138 will conveniently yield, accordingly, by the pulling-away action thereof. The platform structure 12 is laid aside, horizontally, with its back panel member 136 facing upwardly. Unlock the threaded fastener 95 from the lever bar 76 and return the counter pivotal structure 74 to its suspended position, as in FIG. 6, for example. Ensure that the auxiliary legs 108 and 110 and the leveling legs 124 and 126 are returned to their fully retracted positions and locked by their respective threaded fasteners 114, 116 and 130, as in FIG. 1, for example. Unlock the threaded fastener 72. This immediately permits the composite leg units 16 and 18 to be pivotally retracted one toward the other, causing the free end 70 along with its stabilizer bar 68 to pivotally yield upwardly in an approximate 90 degree arc, whereupon the composite leg units 16 and 18 are fully retracted and co-planar, while the stabilizer bar 68 is vertically disposed adjacent thereto, as shown in FIG. 5. The co-planar composite leg units 16 and 18 are then secured compactly to the platform structure 12 in a manner illustrated in FIG. 6, which shows that the upper horizontal member 25 is urged into the yielding receiving clip 140, the corresponding main leg 20 is urged into the yielding side receiving clips 138, while the lever bar 76 secures its counter pivotal structure 74 by being urged into the yielding co-pivotal receiving clip 142, which pivotally adapts relative thereto (as shown by arrow 146 in FIG. 8). The pivotal support member 100 is pivotally disposed transversely upon its respective lever bar 76. In FIG. 5 the easel 10 is arranged in its most compact collapsed condition, accommodating the means in which to store the same within a minimal space. In FIG. 6 the auxiliary legs 108 are partially extended from their fully retracted position shown in FIG. 5 and locked therein by threaded fasteners 114, disposing the lower horizontal member 58 a suitable distance away from the adjacent horizontal edge of the platform structure 12, providing a convenient handle means in which to transport the collapsed compact easel 10 when the same is inverted from the position shown, for the intended purpose. The convenient size and light-weight of the collapsed easel 10 illustrated in FIG. 5 permits the same to also be contained within an appropriate artist's canvas bag or otherwise similar carrying case.

The collapsible easel may be constructed of suitable material, such as plastic, metal, wood and the like or practical combinations thereof, by way of example and not limitation, employed in an appropriate manner in which to embody the useful and novel features thereof for the purposes intended.

The foregoing description illustrates a preferred embodiment of the invention. The concepts employed may, based upon the description, be employed in other embodiments without departing from the scope of the invention. Accordingly, the following claims are intended to protect the invention broadly, as well as in the specific forms shown herein.

I claim:

1. A collapsible easel for use by an artist comprising in combination; a platform structure having a supportive top surface area, opposite side edges, opposite end edges, receiving means secured to one end portion and one side portion of the back surface area and a co-pivotal receiving means securing one of its ends to the central portion thereof, having its opposite end pivotal 360 degrees therefrom; and a composite outer leg unit including a first pair of parallel main legs having upper ends connecting at right angles to opposite ends of an inwardly disposed rigid horizontal member interconnecting a rotatable outwardly disposed first upper horizontal member, and lower ends connected to a first pair of opposed side coupling means, a first lower horizontal member having opposite ends connected at right angles, by a first pair of opposed side rigid connective means, to lower ends of a first parallel pair of co-extendible auxiliary legs correspondingly housed longitudinally in said first pair of main legs, a pivotal connective means engaged in the horizontal axis of said first lower horizontal member; and a composite inner leg unit appropriately shorter in overall length and width than said composite outer leg unit includes a second pair of parallel main legs having upper ends connecting at right angles to opposite ends of a second upper horizontal member, and lower ends connected to a second pair of opposed side coupling means, a second lower horizontal member having opposite ends connected at right angles, by a second pair of opposed side rigid connective means, to lower ends of a second parallel pair of co-extendible auxiliary legs correspondingly housed longitudinally in said second pair of main legs, a first pivotal guide means pivotally interconnected in the horizontal axis of said second lower horizontal member, by bearing means contained therein, having a first releasable locking means, a second pivotal guide means pivotally interconnected in the horizontal axis of said second upper horizontal member, by bearing means contained therein, having a second releasable locking means; and said composite leg units share a stabilizer bar means having one end secured into said pivotal connective means extending perpendicularly in alignment therefrom slidably engaging through said first pivotal guide means connecting its opposite free end into a cap means, co-axial means interconnected between the upper and lower ends of each said first and second main leg having opposite facing branch members pivotally joined by bearing means contained therein in a common horizontal axis thereof, thereby enabling said composite leg units to be pivoted in opposite directions away from their inoperative co-planar collapsed position to operative extended positions within quadrant arcs thereof pivotally disposing said stabilizer bar means respectively from an inoperative vertical position to an operative horizontal position thereof and locking therein by said first locking means to supportively maintain said extended positions; and leveling legs individually housed longitudinally in each said auxiliary leg having their outer lower ends secured into individual base member; and each said pair of auxiliary legs co-extend slidably downward from their respective housed positions thereby providing said easel with height and leveling adjustment when same is in an operative extended position; and each said leveling leg individually extend slidably downward from their respective housed positions thereby providing said easel with leveling and height adjustment when same is in an operative extended position; and each said side coupling means and each said side rigid connective means include a releasable locking means in their lower portions maintaining respectively said auxiliary legs and said leveling legs in their extended or fully retracted positions and each also include a bushing means secured into lower apertures corresponding to said auxiliary and leveling legs; and said composite inner leg unit also includes a pivotal support means comprised of a slidable hinging connective means, a turn-mount means interconnected at right angles to a parallel pair of opposite side members, having a lever bar means connecting one end into said hinging connective means extending perpendicularly therefrom intersecting slidably through said second pivotal guide means connecting its opposite end into a cap means, thereby providing a pivotally coordinated counter pivotal structure thereof, transferable from an inoperative co-planar position in said composite inner leg unit to operative pivotal and translatable positions within a 360 degree arc from said second upper horizontal member when said composite leg units are pivotally extended in said operative positions.

2. A collapsible easel as defined in claim 1 wherein each said receiving means include a lengthwise open region of certain spring properties to yield in a releasable engaging manner whereby to secure said inoperative positions of said composite leg units, said counter pivotal structure and said stabilizer bar means to said platform structure providing a compact collapsed arrangement of said easel for transporting and storing.

3. A collapsible easel as defined in claim 2 wherein when each said receiving means yield to the convenient release of said platform structure from said compact arrangement thereof and when said composite leg units, said counter pivotal structure and said stabilizer bar means are then arranged in their respective operative positions, said receiving means releasably engage said platform structure operatively to said first upper horizontal member respectively widthwise or lengthwise thereto, and said co-pivotal receiving means, adaptable pivotally thereto, releasably engages said turn-mount means, thus operatively engaging said counter pivotal structure whereby said lever bar means being translatable therealong its longitudinal axis between its opposite ends regulates said platform structure is supported optionally selected angular positions within an approximate 90 degree arc thereof, and said first upper horizontal member rotatably yields accordingly therewith while said second releasable locking means maintains said angular positions.

4. A collapsible easel as defined in claim 3 wherein said platform structure is additionally supported in a tilting-rotational mode of operation dependent upon said counter pivotal structure while independent of said first upper horizontal member.

5. A collapsible easel as defined in claim 1 further comprising a stop means outwardly projected in the upper portions of each said auxiliary and leveling leg carried downwardly therewith by slidable extensions thereof into a contacting relationship with said bushing means, in a corresponding manner, maintaining said upper portions in proper housed positions when said legs thereof are in fully extended positions.

6. A collapsible easel as defined in claim 2 wherein said auxiliary legs and said leveling legs are in fully retracted positions in their respective housings of each said composite leg unit thereof and when said first pair of auxiliary legs are partially co-extended therefrom and subsequently locked therein by their said respective locking means to dispose said first lower horizontal member suitably away from the adjacent edge of said platform structure thereof, a handle means is provided for convenience of transporting said easel in its said compact collapsed arrangement.

7. A collapsible easel as defined in claim 1 further comprising an accessory attachment means having a first open compartment in its forward main region, a second open compartment in its upper rearward region each with enclosed opposite ends for containing drawing implements and the like therein and said second open compartment forms an upper support means partially extended longitudinally forming a channel means with a flange means through which adjustable locking means are threadedly engaged and longitudinally spaced therealong whereby to releasably engage therein an end or side edge of said platform structure and to secure and support an elective overlying drawing surface optionally therewith.

* * * * *